United States Patent [19]

Franzen

[11] Patent Number: 4,848,111

[45] Date of Patent: Jul. 18, 1989

[54] LOCKING DEVICE FOR CASES, SUCH AS BRIEFCASES AND THE LIKE

[75] Inventor: Eberhard Franzen, Solingen, Fed. Rep. of Germany

[73] Assignee: Franzen Sohne (GmbH & Co.), Solingen, Fed. Rep. of Germany

[21] Appl. No.: 116,234

[22] Filed: Nov. 3, 1987

[30] Foreign Application Priority Data

Nov. 5, 1986 [DE] Fed. Rep. of Germany ..... 3734695
Oct. 14, 1987 [DE] Fed. Rep. of Germany ... 8629612[U]

[51] Int. Cl.[4] ..... E05B 65/52
[52] U.S. Cl. ..... 70/69; 70/312
[58] Field of Search ..... 70/312, 67–76, 70/304, 315–318

[56] References Cited

U.S. PATENT DOCUMENTS 3,961,505 6/1976 Gehria ..... 70/312
4,356,712 11/1982 Bako ..... 70/69
4,395,892 8/1983 Remington ..... 70/312

FOREIGN PATENT DOCUMENTS 333162 4/1985 Fed. Rep. of Germany .

*Primary Examiner*—Robert L. Wolfe
*Attorney, Agent, or Firm*—Burns, Doane, Swecker & Mathis

[57] ABSTRACT

A locking apparatus for briefcases and the like includes a pair of latch-securing mechanisms mountable on one case section for releasably securing latches mounted on the other case section. The latch-securing mechanisms include sliders which are slidable in opposite longitudinal directions. A push button located adjacent a longitudinal center of the locking apparatuses simultaneously releases both sliders for spring-biased movement to a latch-releasing position. A combination lock restrains the push button when off-combination and releases the push-button when on-combination.

13 Claims, 11 Drawing Sheets

Figure 1:
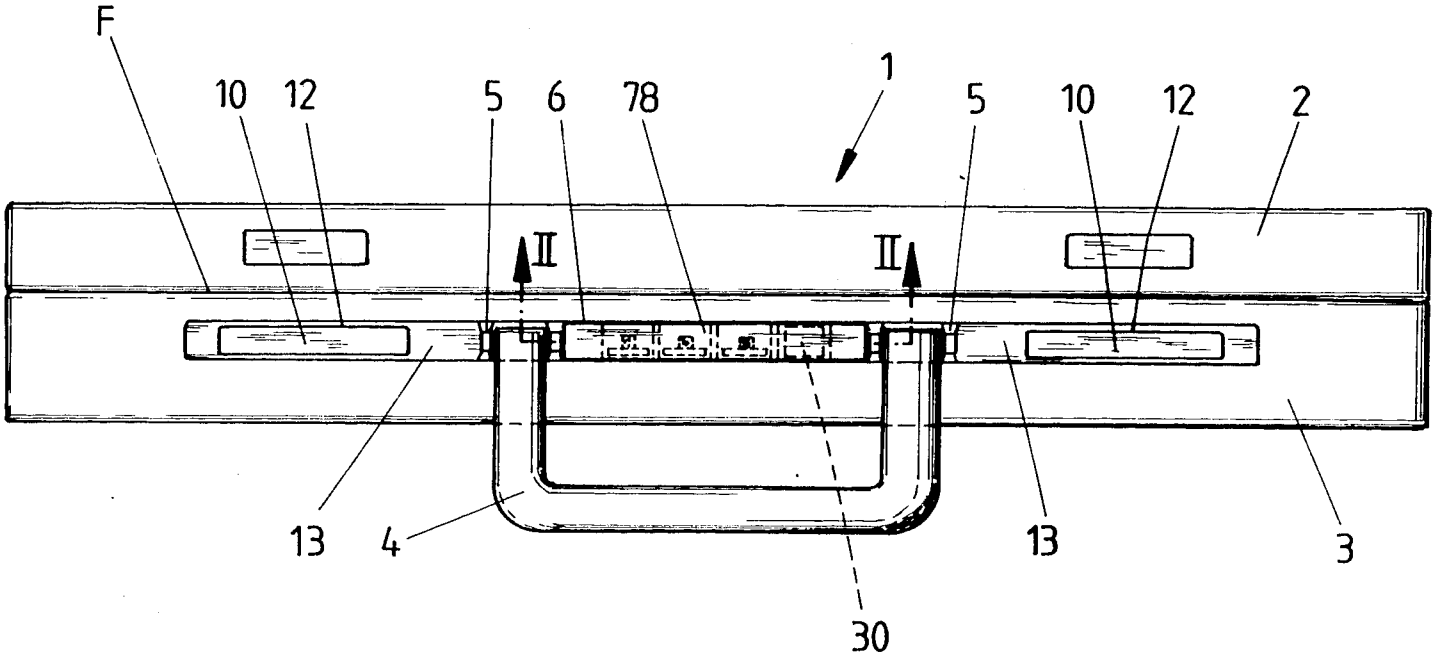

III
III

P
VII
V
X
77
78
6
56
52
55
51
56
50
35
62
63
69
67
68
70
69
35
34
35'
40
41
30
27
37
39
36
7
53
9
8
63
9'
61
66
32
62
29
44
45
48
33
47
46
49
34
29
8'
74
73
48
30''
27
28
30'
44
35'
35''
54
35
50
51
38
36
39
37
52
55
59
54'
32
60
64
68
62
53
62
67
8
73
9
28
33
47
45
33
30'
30
28
29

LOCKING DEVICE FOR CASES, SUCH AS BRIEFCASES AND THE LIKE

The invention concerns a locking device for cases, bags, in particular briefcases or such like, with a centrally-situated combination lock on one of the two case halves and, leading away from the lock in opposite directions, sliding bolts which interact with latches from the other case half and whose longitudinal displacement is blocked when the locking device is in the locked position.

The applicant is aware of the existence of such locking devices fitted with centrally situated combination locks, for example from DE-OS No. 33,36,162. When the correct combination is set, the sliding bolts can be displaced by means of activating buttons at their far ends, thereby releasing the latches. As it is relatively difficult to achieve simultaneous release of the spaced-apart latches, due to the lack of a control for this purpose, premature release of one of the two latches can lead to excessive strain on the other latch, which has not yet been released, should the case be subject to high pop-open pressure, for example because of over-filling.

The task of the invention is to achieve greater ease of operation using the advantageous central position of the combination lock in a simple design.

This task has been fulfilled by the invention stated in claim 1.

The subordinate claims are advantageous further developments of the locking device invented.

The result of this design is a conventional locking device with higher service value. The release of the latches is also effected by means of the centrally-situated combination lock. This can comfortably be done with one hand. The operating hand that sets the combination can thus remain in the same place, i.e., in the button area, and conduct the release operation in question. The displacement of the sliding bolts occurs simultaneously. With constructional simplicity, the device has been designed such that, on the combination lock side, the end segments of the sliding bolts, which are spring-loaded in the direction of opening, are contacted at right angles to the longitudinal displacement of the sliding bolts by stationary catches, which are released by an activating push-button which can be locked by the combination lock. The combination lock device itself remains free of stress. A longitudinal displacement of the sliding bolts away from the lock then occurs. This can be released by a relatively short activating stroke. Advantageously, the stationary catches take the form of projections that, in the locked position, engage in openings in the sliding bolts. This type of design not only contributes to the latitudinal stability of the sliding bolts, it also results in a rather compact structure. It is also advantageous that the projections should be constituted by end segments of the guide walls that form the shaft for the activating push-button. These projections are minimal extensions of the shaft-forming walls which are situated at a gap from each other along the axis of displacement. The area in question is extremely sturdy, simply by virtue of its shaft-shape. The following feature is also constructionally advantageous: the sliding bolts are housed in longitudinally-displaceable fashion in C-profile slides open in the direction of the combination lock, the end segments of the sliding bolts being slanted such that a gap is formed to the C-profile slide web. This provides useful extra space for the unlocking of the sliding bolts occasioned by the activating push-button; it also has the advantage of conveniently providing room to house the spring pushing the sliding bolts in the locking direction. It is also possible to dispense with the spring if the inclined edge is so gradual that the material of the sliding bolts is sufficiently thin to constitute a very springy tongue. This solution is to be preferred with a view to keeping the number of constructional units needed for the design as low as possible. It is also advantageous that the end segments of the sliding bolts should be equipped with leading inclined edges which interact with the projections. As a result, the sliding bolts and the corresponding projections are coupled in a trap-like fashion. The end segments of the sliding bolts yield in a spring-like manner, after which they snap in suddenly behind the projections, latching on rather like hooks. Optimal functioning of the trap is achieved by fitting the sides of the projection facing away from the activating push-button with counter-leading inclined edges. With preferably equal inclination of the two edges, extremely low-friction and thus wear-resistent guide surfaces are thereby achieved, so that it is even possible to dispense with expensive injection-molding material, i.e., the sliding bolts may be made of plastic. It is also planned that the locking of the activating push-button should occur by means of a locking bar which is part of the combination lock and projects into the displacement path of the activating push-button. A bar like this could for example be situated in front of the lower end of the activating push-button. Another possible advantageous solution would be that the movable locking bar, which can be displaced upon setting the correct combination, i.e., when the combination lock is in the opening standby position, should be equipped with a guide inclined edge, which interacts with the activating push-button when it is pressed down. This makes it possible to displace the locking bar when the sliding bolts are lifted out of the area of the projections. In the invention it is also proposed that the activating pushbutton should possess a holding shoulder on the side facing away from the activating surface, this holding shoulder lapping over a limiting stop in one of the guide walls of the shaft. This exactly determines the normal position of the activating push-button. This activating push-button is pushed in the direction of its normal position by a spring, this spring being situated in the interior of the hollow activating push-button and resting against a stationary supporting tab, which projects into the interior in the shape of a tongue.

The fact that the activating button is hollow constitutes a saving in material which is likely to be an important factor nowadays.

Figures 2, 3:
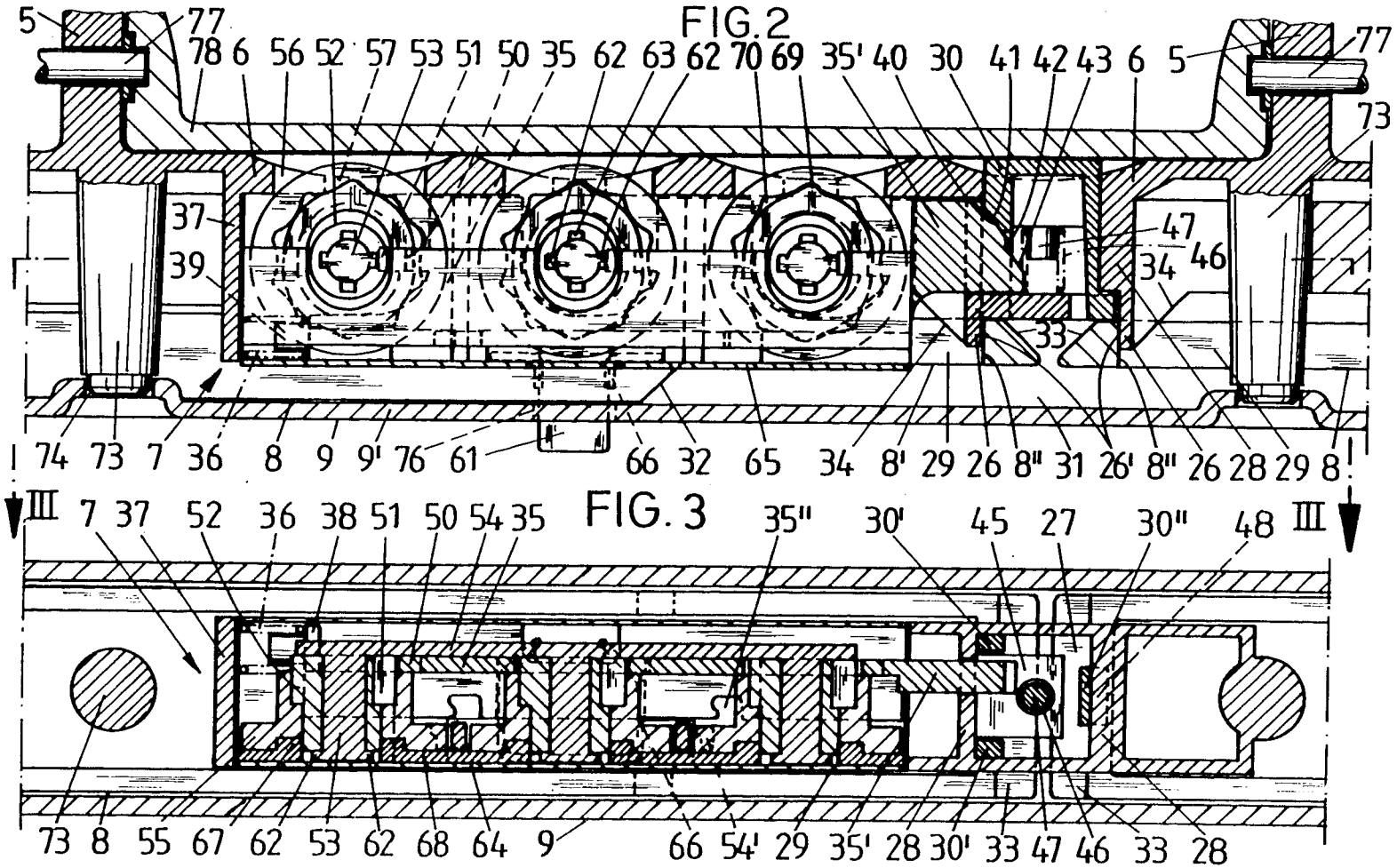
Figures 4, 5:
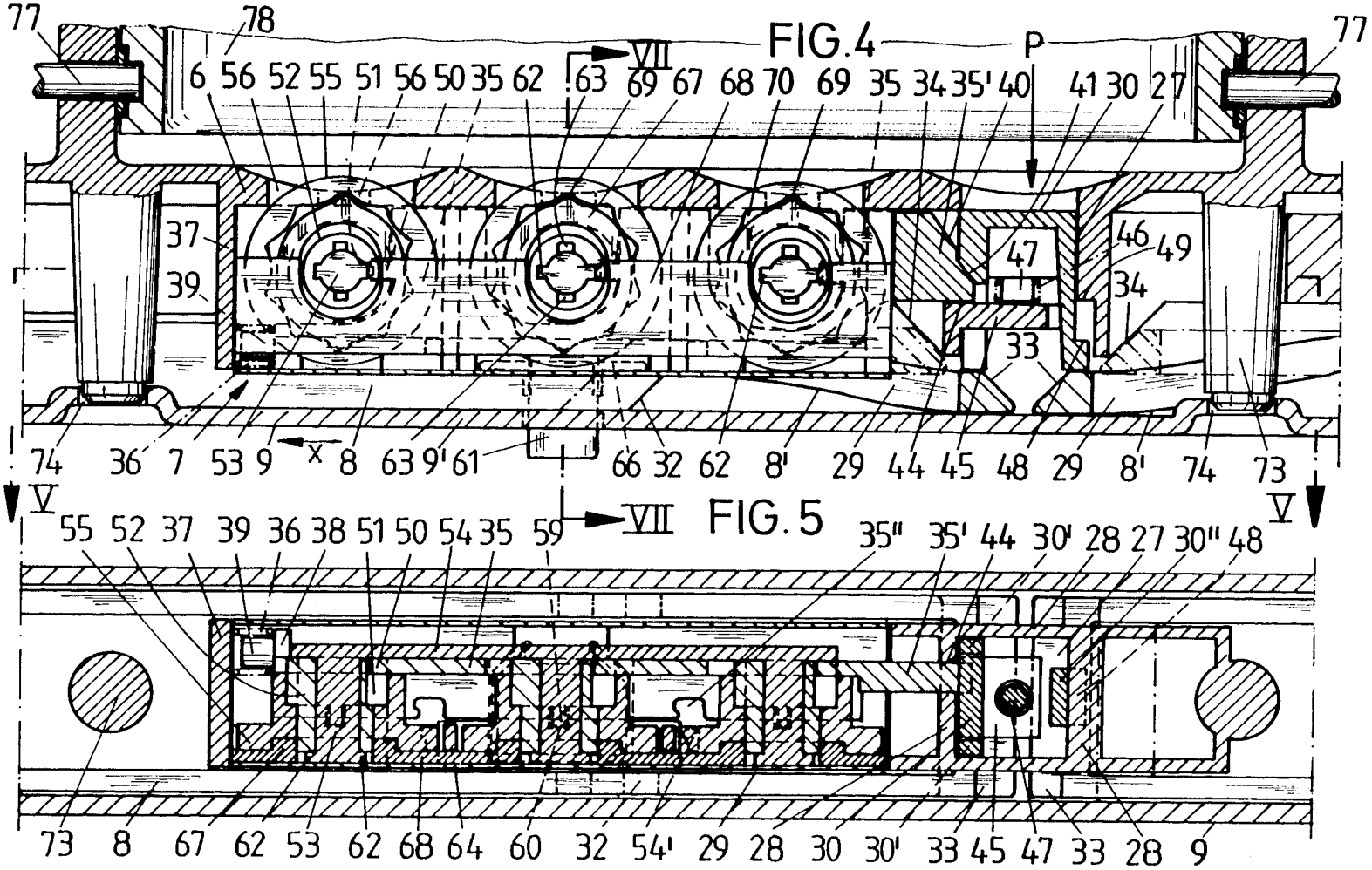
Figure 6:
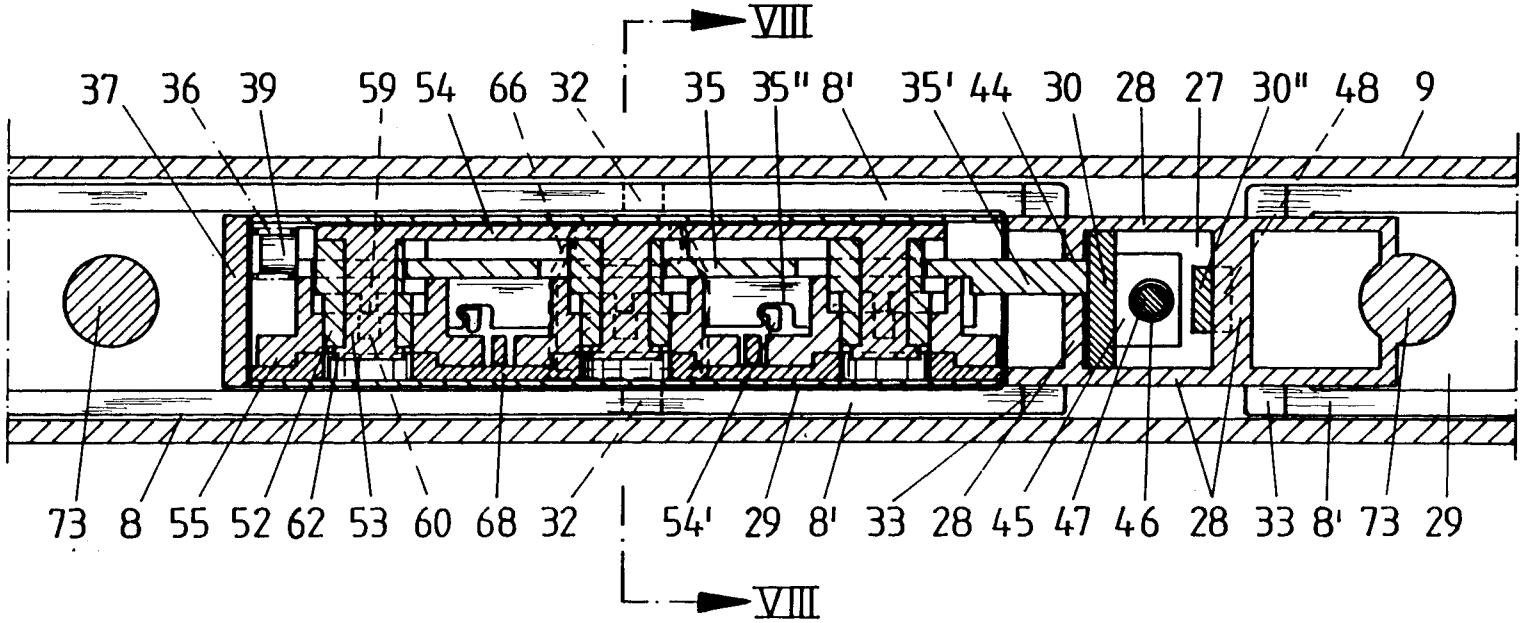
Figure 7:
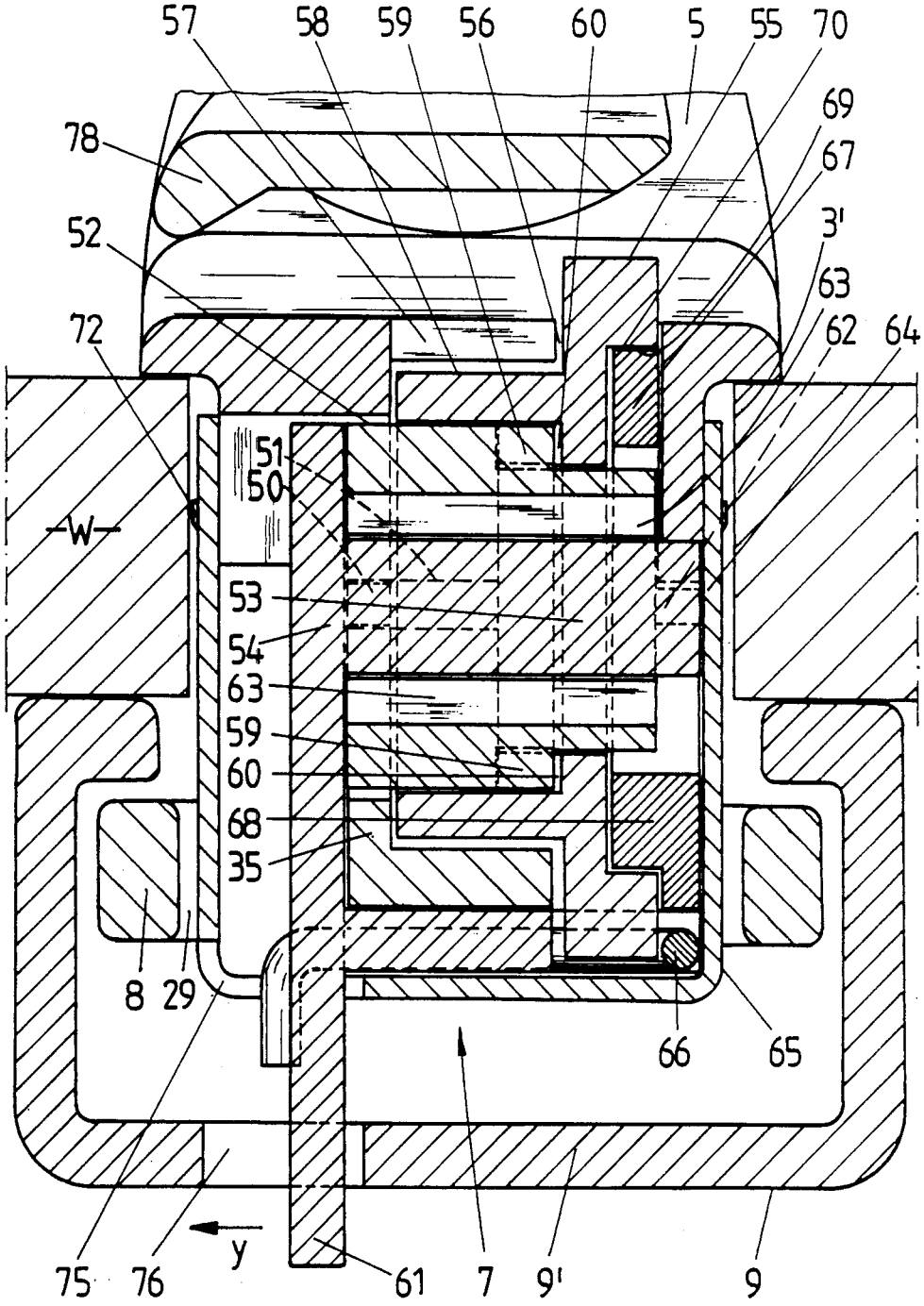
Figure 8:
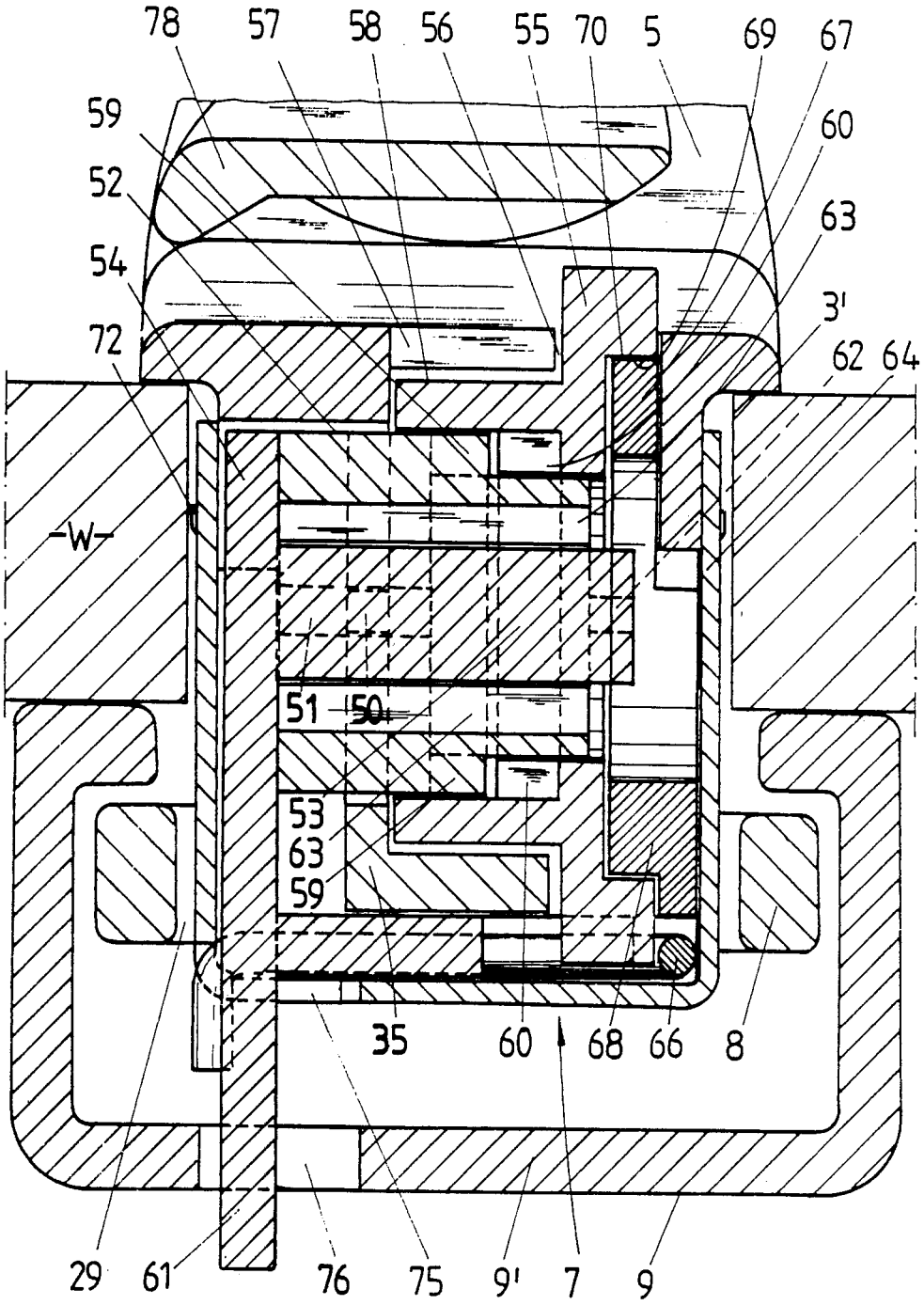
Figure 9:
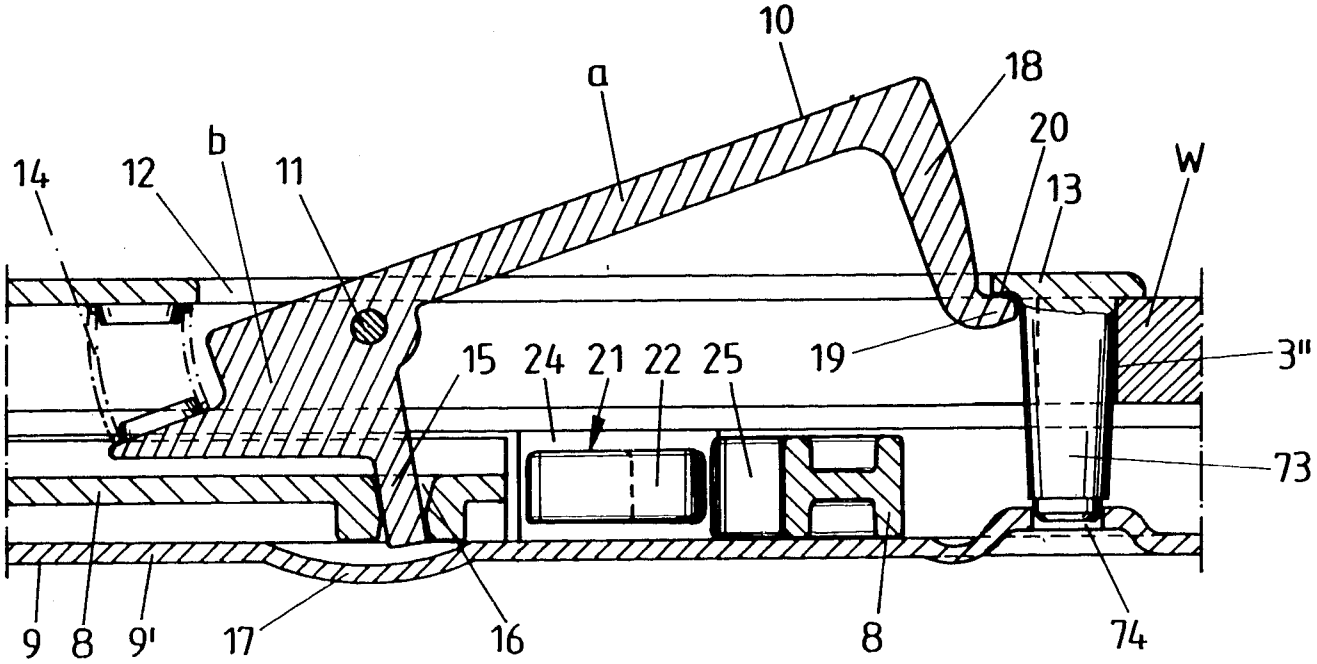
Figure 10:
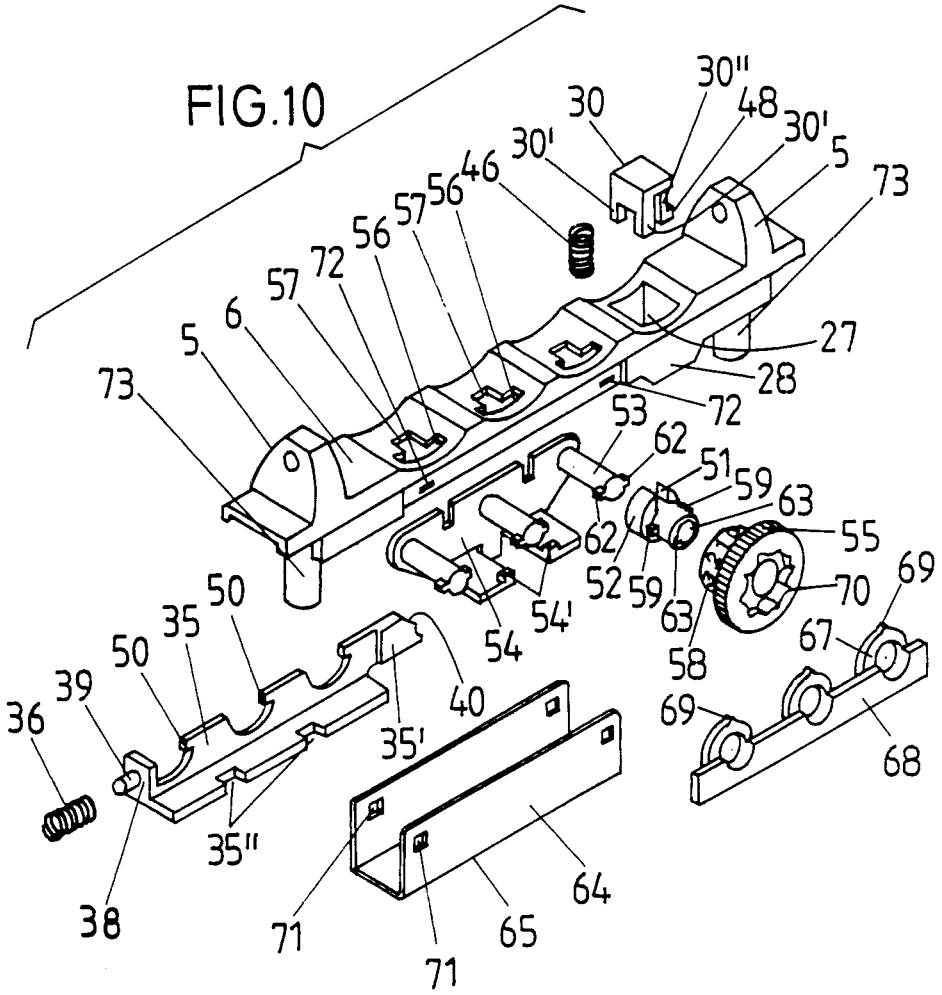
Figure 11:
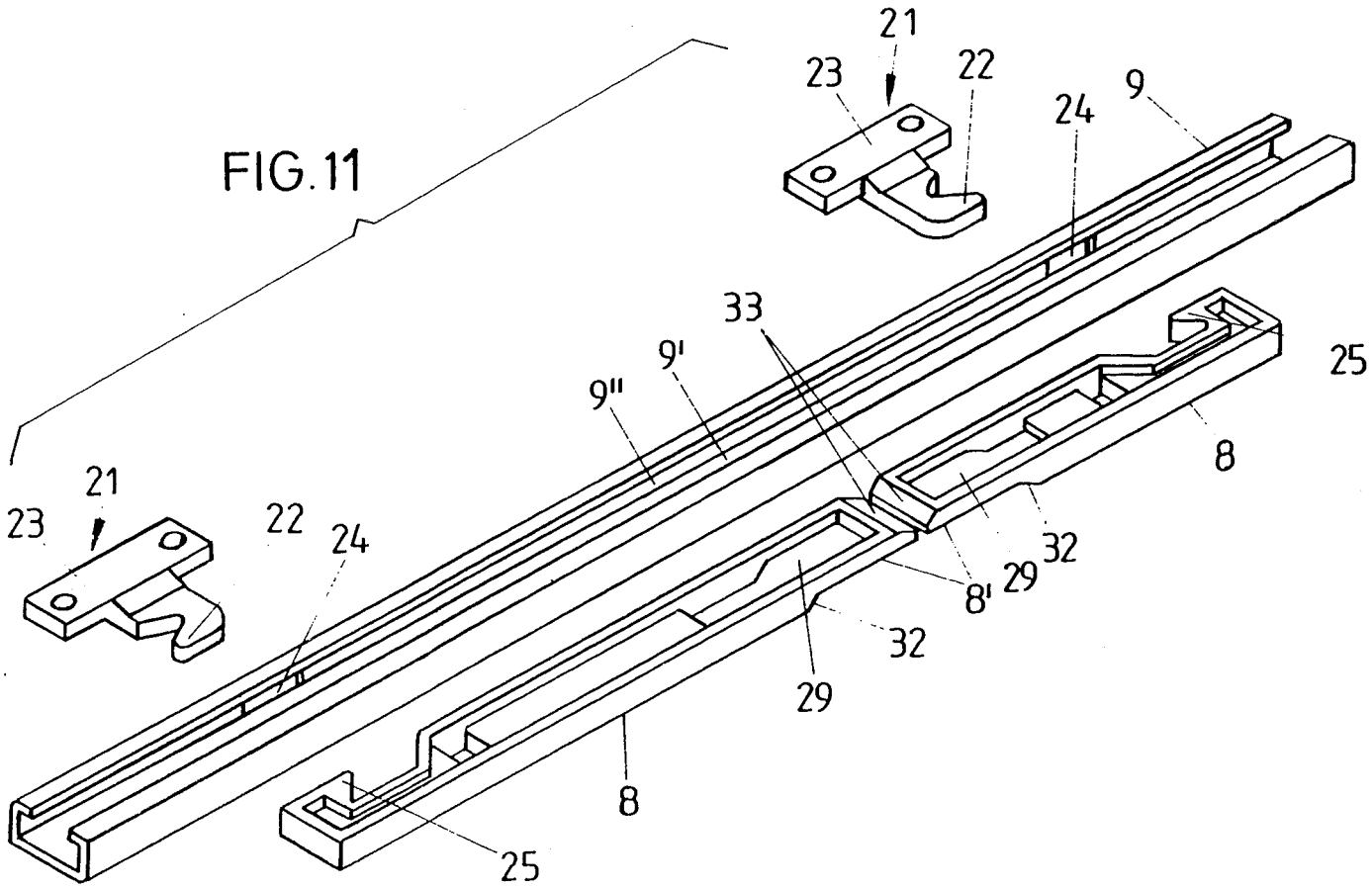
Figures 12, 13:
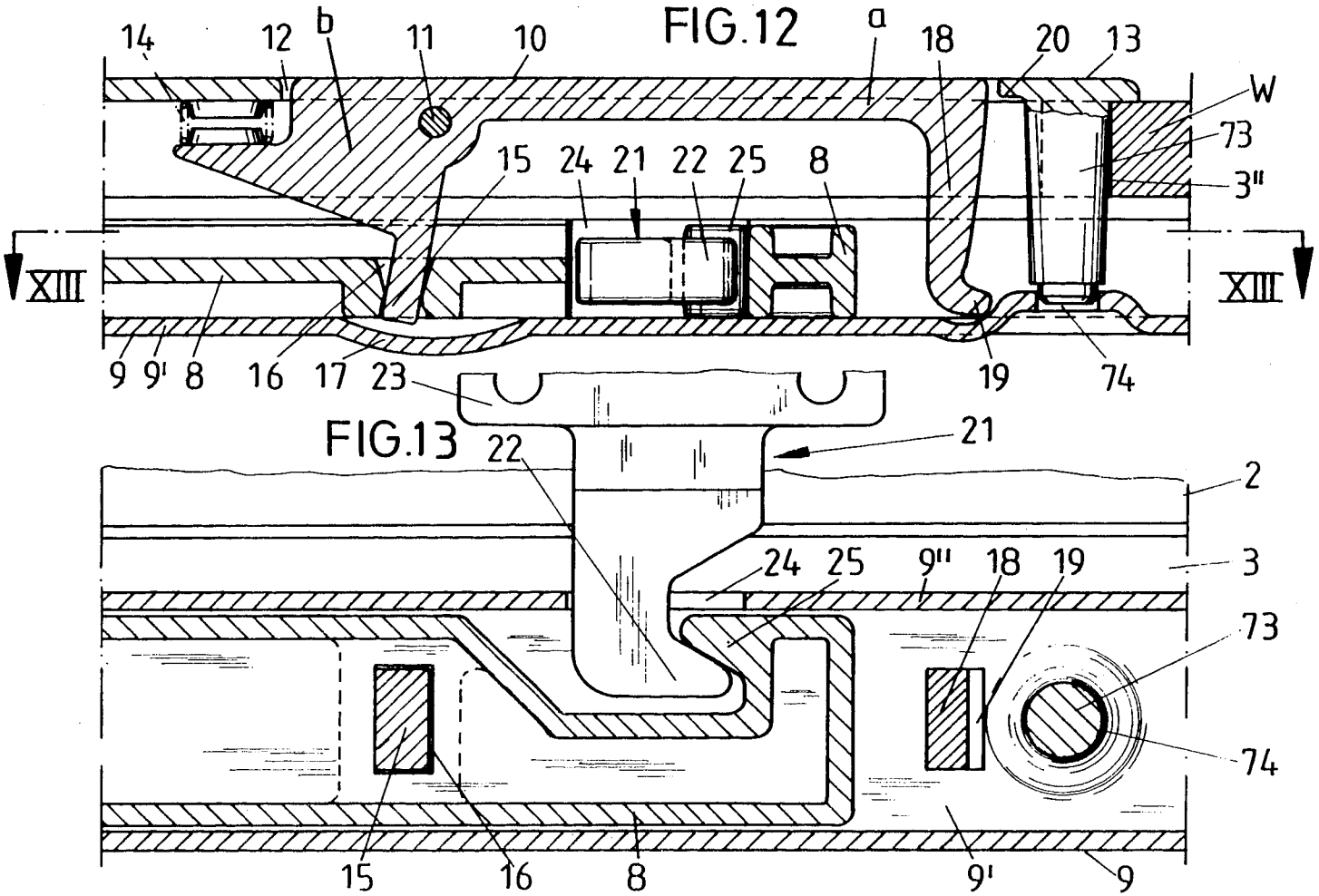
Figure 14:
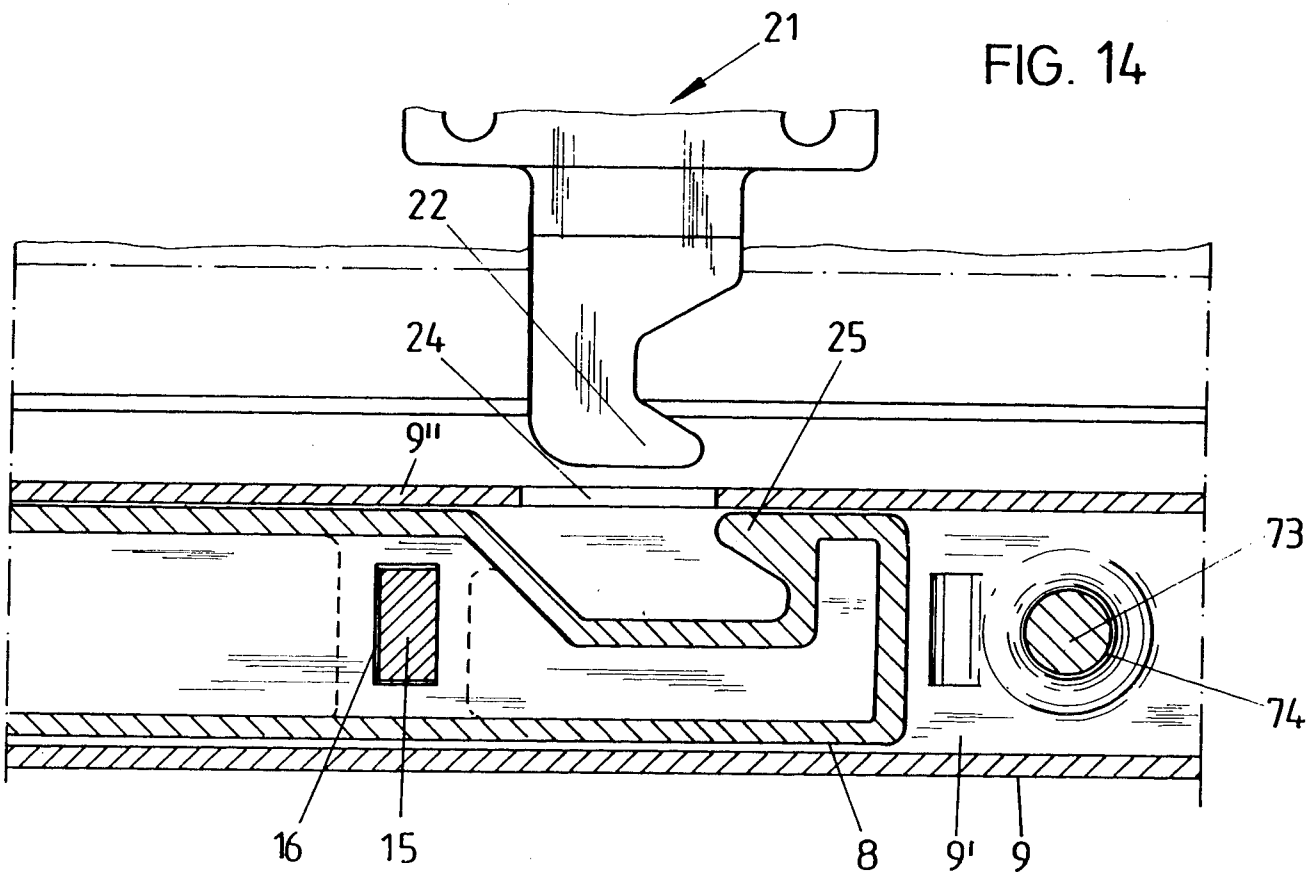

The object of the invention is explained in more detail below, with the help of an illustrated design example. It shows:

FIG. 1 Top-view of the front end of a briefcase fitted with the locking device invented, FIG. 2 Section determined by line II—II, i.e. the locking device in the locked position with correctly set combination ("Opening standby position"), FIG. 3 Section determined by line III—III in FIG. 2, FIG. 4 Locking device in the unlocked position in an intermediate phase, FIG. 5 Section determined by line V—V in FIG. 4, FIG. 6 Illustration corresponding to FIG. 5, with the difference that the opening displacement of the sliding bolts has been completed and that the combination lock has gone into the resetting standby position, FIG. 7 Section determined by line VII—VII in FIG. 4, FIG. 8 Section determined by line VIII—VIII in FIG. 6, both sections magnified considerably and illustrating the functioning of the new combination-setting device, FIG. 9 Longitudinal section determined by extension of line II—II in FIG. 1, showing a sliding bolt activation lever, with the sliding bolt in the open position, FIG. 10 Perspective view of the essential parts of the dismantled combination lock FIG. 11 Perspective view of the dismantled sliding bolt assembly, with C-profile slides and latches, FIG. 12 Diagram like FIG. 9, with the difference that the sliding bolt is in the closed position, FIG. 13 Section determined by line XIII—XIII in FIG. 12 and FIG. 14 Diagram corresponding to FIG. 13, with the difference that the latches have been released.

The briefcase 1 illustrated in FIG. 1, which is resting on its narrow hinged side, possesses a shell-shaped upper case half 2 and a shell-shaped lower case half 3. The case halves 2, 3 interlock in the junction area F.

A holding grip 4 is attached to the lower case half 3 by means of hinge connections. It has a handle-shaped, i.e. U-shaped design. The points of the U fit into small support assemblies 5. The latter are protruding tips of a bracket 6. The holding grip 4 is centrally situated, thus equidistant from the two ends of the front narrow side.

The bracket 6 is a component of a combination lock 7, which pointing towards the interior of the case, extends from one small support assembly 5 to the other.

The combination lock 7 permits simultaneous controlled release of the two sliding bolts or sliders 8, whose longitudinal displacement is blocked in the locked position (FIG. 2) of the locking device illustrated.

The sliding bolts 8 run in a C-profile slide or housing 9 which is elongated in a longitudinal direction (i.e., left-to-right in FIG. 4). This is integrated into the lower case half 3, and out of sight. It (8) extends in parallel fashion, in the neighborhood of the junction area F of the case halves 2, 3. It runs along in the plane of the center of balance, just like the entire combination lock part of the locking device, so that the perpendicular alignment of the briefcase 1 during carrying is guaranteed at all times.

The open side of the C-profile slide 9 points in the direction of the combination lock 7; the combination lock extends partly into the slide, the rest of it being housed in a window-shaped cut-out portion 3' of the wall W of case half 3. (see FIG. 7.)

The outward-facing ends (i.e. facing away from the lock) of the sliding bolts 8 (which run in the same longitudinal plane) are each connected to an activating lever 10. These are two-armed levers which pivot on stationary joint pins 11. The longer lever arm of the sliding bolt activating lever 10 extends out through a window-like opening 12 on the top side of a contact piece 13, to which the joint pin 11 is also attached; this arrangement makes easy access to the activating lever possible. The projecting length of the activating lever 10 makes it easier to find it in the dark by touch. In the closed position the lever arm a plunges into the window-like opening 12, the top side of the activating lever 10 flush with the top side of the contact piece 13. This position is depicted in FIG. 12. 11 is situated perpendicular to the direction of extension of the sliding bolts 8, parallel to the front narrow side of the briefcase 1.

The other, shorter lever arm b, which faces the combination lock 7, does not protrude at any time, and remains subject to the action of a coil spring 14 at all times. One end of this spring rests against a centering pin on the underside of the contact piece 13, whereas the other end of the spring, also held in place by a similar centering pin, acts on the shorter lever arm b.

Near the pivot point of the activating lever 10, i.e. below the joint pin 11, the activating lever forms a trigger 15. The trigger fits into a trigger gap near the free end of the sliding bolt 8. The contour of the trigger opening 16 includes a mass of material resembling a swelling, pointing towards the web 9' of the C-profile. Below the free end of the trigger 15, this web forms a slight trough 17, which ensures that the trigger 15 can pivot without contact even with high trigger penetration.

Pointing in the same direction, i.e. also pointing towards the web 9' of the C-profile slide, is the bent free end 18 of the longer lever arm a of the activating lever 10. This also protrudes through the window-like opening 12; at its tip is a knob 19, which runs outwards, parallel to the activating lever 10. This knob, limited by a stop, rests against an inner shoulder 20 on the edge of the opening. The contact pressure results from the force exerted by the spring 14.

The body of the activating lever 10, seen lengthwise, is bridge-shaped; under the lever-arm a, there is enough room for the entry of a pair of latches 21. These latches each possess a flat hook head 22. This extends down from a fastening bracket 23, which is attached to the wall of the upper case half 2.

The closing action of the hook head 22 occurs in a perpendicular manner. For this purpose, the flange 9'' of the C-profile slide 9 facing the upper case half 2 possesses an inlet slot 24, suitable for perpendicular action. The jaw of the hook head 22 points in the direction of the outward end of the sliding bolt 8. The end of the sliding bolt possesses a closing hook 25 with matching shape. Its hook jaw points in the opposite direction, i.e. towards the combination lock 7. The depth of the jaw is at least as large as the displacement stroke of the sliding bolt 8.

The closing hook 25 is situated in the half of the relatively narrow and flat-shaped sliding bolt 8 facing the latch.

Both sliding bolts are made of plastic material, preferably injection-molded. To prevent shrinkage, which often occurs with appreciable accumulations of material, a frame-like design has been chosen with web segments as thin as possible connecting the frame flanges (as can clearly be seen in FIG. 11).

In the locking device's closed position, the anchoring end segments 8' on the combination lock side contact catches 26 on the combination lock 7. These catches are tips of the bracket 6. As can be seen in FIG. 2, the catches 26 are projections pointing towards the bottom of the C-slide 9, or extensions of the walls 28 forming a perpendicular shaft 27, i.e., exlusively extensions of the walls which are separated by a gap along the axis of displacement of the sliding bolts 8. The catches 26, i.e. the projections forming them, fit into longitudinal slit-like openings 29 in the sliding bolts 8. The vertical contact or stop surface 26' of the catches 26 fits against a counter contact surface or stop shoulder 8″, also vertical, of the opening 29 in the sliding bolt 8.

To spring the relevant end segments 8′ of the sliding bolts 8 out of the closed position, a vertically displaceable activating push-button 30 above the end segments is employed; this button thus moves in the direction of the web 9′ of the C-profile slide. On the operating area side, the button practically protrudes past the front plate of the bracket 6 constituting the combination lock. Movement of the activating push-button 30 is blocked by the combination lock when the wrong combination is set.

The lower ends of the activating push-button 30, which terminates in feet 30′, 30, and 30″, fit down against the corresponding top side of the sliding bolt end segments 8′. This is shown in FIG. 3. The springing out is the result of downward pressure on the free-floating, protruding end segments 8′, which face each other; this pressure is thus perpendicular to the longitudinal displacement of the sliding bolts 8. This free-floating design of the ends can clearly be seen in FIG. 11; it can also be seen in FIG. 2.

The free space 31 required behind these end segments 8′, between the lower side of the end segments and the corresponding segment of the C-profile web 9′ is cut away from the bottom of the sliding bolts. The resulting gap 32 runs into the segment of the sliding bolts which rests directly on the web 9′. The reduction in thickness amounts to about 50%.

The activating push-button 30 bridges the small gap between the end segments 8′ of the sliding bolts, which face each other; when activated, it thus simultaneously releases both of the sliding bolts 8, which are spring-loaded in the direction of opening.

On the side facing the activating push-button 30, the end segments 8′ of the sliding bolts 8 are equipped with leading inclined edges 33 which interact with projections or catches 26. The incline of these edges amounts to about 45%, which gives the sliding bolts 8 what one might call a trap function. To achieve wear-free operation, the sides of the projection or catches 26 facing away from the activating push-button are fitted with counter-leading inclined edges 34, so that when the sliding bolts 8 move towards each other (Cf. dotted lines in FIG. 4), these end segments of the sliding bolts 8 are directed downwards, towards the web 9′, against their restoring force; after which, when the positions of the contact surfaces 26′ of the catches and the counter contact surfaces 8″ match, the end segments snap into the locked position. (See FIG. 2.)

As has already been mentioned, downward displacement of the activating push-button 30 is only possible when the correct combination is set. The locking of the activating push-button 30 is effected by means of a locking bar 35 which is part of the combination lock 7 and whose locking head 35′ projects into the displacement path of the activating push-button 30, this displacement path being perpendicular to the locking bar.

The locking bar 35, which is housed in longitudinally-displaceable fashion in the housing of the combination lock 7, is subject to the pressure of pressure spring 36. This spring rests against an end wall 37, which extends from the bracket 6, facing the web 9′. The end of the spring opposite this support pushes against a perpendicular wall 38 of the locking bar 35. The screw-thread spring which acts as the pressure spring 36 is secured by a spindle 39 passing through the interior of the spring.

The locking head 35 of the locking bar 35 is fitted with a guide inclined edge 40. There is a corresponding guide counter inclined edge 41 on that side of the activating button 30.

The incline of the edges 40 and 41, whose surfaces touch fully, amounts to somewhat more than 45° to the horizontal displacement direction of the locking bar 35. Adjacent to the guide edge 40 is a short segment 42, which has no guiding function; adjacent to it is a stair-shaped side 43, which matches guide edge 4. The counter guide edge 41 rests against this stair-shaped side when the activating push-button 30 is pushed down. (See FIG. 4.)

For the locking head 35′, there is a perforation 44 in the relevant wall 28, perpendicular to the shaft 27. The lower edge of the perforation 44 runs into a tongue-shaped supporting tab 45, which extends in the direction of the locking bar displacement into the cross-section area, i.e. into the interior of the hollow push-button 40. The top side of the supporting tab (45) constitutes the support for a spring 46, which pushes the activating push-button in the direction of its normal position. To ensure the axiality of this spring 46, which is a screw-thread pressure spring, the top of the hollow activating push-button 30 is shaped like a holding plug 47. This plug faces downwards, and the gap between its lower end and the above-mentioned supporting tab is at least as large as the displacement stroke of the activating push-button 30.

The locking head 35′ is situated beside the spring construction 46/47.

Furthermore, the activating button 30 possesses a holding shoulder 48 on the side facing away from the top operating surface, this holding shoulder interacting with, and lapping over, the limiting stop 49 on the bracket side (FIG. 2, 4). The holding shoulder 48 is situated at the end of an appropriately springy, outward-facing foot 30″; behind this foot, the contour of the supporting tab 45 has been designed such that there is sufficient free space to allow for easy assembly from above. The other two feet 30′, situated in the same perpendicular plane, extend down either side of the supporting tab 45. Appropriate gaps have also been left here between the longitudinal side edges of the supporting tab and the inner sides of the corresponding walls 28. The feet 30′ rest against the left-hand sliding bolt 8, whereas the other foot 30″, situated in the longitudinal central plane of the combination lock, rests against the right-hand sliding bolt. Thus, the three feet 30′, 30′ and 30″ together form a three-pointed figure. (Cf. FIGS. 3 and 4.) The feet 30′ and the section of the wall 28 located above it thus constitute a sort of gate, into which the locking head 35′ projects partially and through which the supporting tab 45 passes.

The parts composing the device and their locations with respect to one another can be seen especially clearly in FIG. 10. As one can see, the locking bar, which is angular in cross-section, i.e. right-angled, possesses a row of feeler projections 50. There is a total of three of these. Each of them operates in conjunction with a matching depression 51. The blocking collars 52 each fit on an axis 53. There is a total of three of these axes. They extend in a free-floating manner perpendicular to the displacement direction of the sliding bolts 8. They are all projections from a common supporting plate 54, which is also right-angled in cross-section.

When all of the projections 50 match the depressions 51 of their respective blocking collars 52, the locking bar can be displaced in the direction of the arrow x (FIG. 4), against the pressure of the pressure spring 36; this is effected by pushing the activating push-button 30 in the direction of the arrow P, over the guide edge 40.

The blocking collars are designed accordingly, each with a setting disk 55 fitted against it. To make them accessible to the operator, these disks protrude through longitudinal slits 56 in the front plate of the bracket which forms the combination lock. A perpendicular opening 57 extends from these slits to provide a viewing window for the symbols on the indented part of the setting disks 55; in this case, the symbols are numbers ranging from one to ten (zero). These symbols carry the designation 58, and they constitute, as a distinct series of numbers, the lock combination, which can be set and erased at will.

The blocking collars 52 and the setting disks 55 are coupled by means of reversible clutch connections. The clutch projections on the blocking collar side are designated by the number 59. These projections are two small diametrically opposed blocks, which fit into matching clutch recesses 60 in the setting disks 55. This is shown in FIG. 7.

To erase the combination set, the supporting plate 54, which extends into a freely-accessible activating trigger 61, has simply to be displaced in the direction of the arrow y, starting from the previous combination of numbers of course. This results in a displacement of the axes 53 in the same direction; these axes lap over the blocking collars 52 and carry them along as well. This over-lapping is effected by means of two wings 62 on the front ends of the axes 53. These diametrically-opposed wings protrude slightly past the diameter of the axes. The blocking collars 52 are fitted with two longitudinal slits 63 in the hollow blocking collar interior so that they can be slipped on easily. For expediency's sake, the position of the slits is situated outside of the finitely variable ten-tooth wheel, so that the functioning of the lock requires no exact match. If this type of securing mechanism is not used, the blocking collars can simply be secured on the housing side, by means of a flange 64 extending up from a U-shaped lock casing profile 65 in front of the front end of the blocking collar.

The disengaging displacement occurs against the pressure of a spring 66, which pushes the blocking collar 52 back into the setting disk 55 when the trigger 61 is released.

The standby position for the resetting of the combination is controlled by switch projections 45' on the supporting plate side and notches 35'' on the locking bar side. Thus, movement is possible only when the feeler projections 50 slip into the depressions 51 as a result of activation of the activating push-button. Otherwise, the switch projections 54' block the wall of the locking bar 35 in which these depressions are situated. (Cf. FIG. 3.)

As already mentioned above, the ten-tooth wheel is finitely variable, so that the setting disks 55 possess distinct settings. The corresponding stop spring is designated by the number 67. This spring is a bridge-like, arc-shaped projection of a mounting strip 68. The spring knob 69 juts out from the zenith of the arc-shaped projection and fits into the notch settings 70 along the inside of the setting disk 55.

In the flanges of the U-shaped lock casing profile 65, which provides protective housing for the lock device, there are window-like stop openings 71, into which fit securing stop depressions 72 on the longitudinal sides of the bracket 6.

This securing zone is adjusted according to the length and thickness of the flanges.

Finally, there are securing pegs 73 extending down from the bracket 6 below the small securing assemblies 5. These pegs fit into openings 74 in the web 9' of the C-profile slide 9. A screw or a rivet connection can be used here. The contact pieces 13 also possess such securing pegs 73, which fit into corresponding openings 74. The two contact pieces 13 and the bracket 6 can all form one piece. The activating trigger 61 of the combination reset device projects out through perforations 75 and 76; allowances are made in the design of the perforations for the displacement of the trigger. Perforation 76 is located in the web 9' of the C-profile slide 9.

The axis 77, on which the holding grip 4 swings, can also be used for the mounting of a swivelling cover 78 between the two arms of the grip; this cover provides protective covering for the operating side the bracket. The closed position of this cover can be seen in FIG. 1.

The functioning of the locking device can be summarized as follows: when the correct combination is set, the feeler projections 50 on the locking bar 35 slip into the corresponding depressions 51 in the blocking collars 52. This constitutes the opening standby position as illustrated in FIG. 2. When pressure is exerted on the activating push-button 30 (arrow P), the locking bar 35 is displaced in the direction of the arrow x by means of the guide inclined edge 40, against the force of the spring 36. The feeler projections slip in radially. The consequence of this is that the feet 30', 30' and 30'' push the end segments 8' of the sliding bolts 8 out of the locked position with respect to the projections or catches 26. This displacement is effected against the restoring force of these end segments 8'; the counter-contact surface 26' is pushed away from the catch surface 26'. The sliding bolts having thus been released, the screw-thread pressure springs 14 cause the sliding bolts to pull out of the locking area via the activating lever 10. (The illustration in FIG. 4 shows only the release itself. In this low position, the bolts 8 have long since been pushed up by the elastic force into the position indicated by the dotted lines.)

Having withdrawn past the area of the shaft 27 formed by the walls 28, the end segments spring the sliding bolts back into their original position, i.e. parallel to, and at a small distance from the web 9'. The end segments then come to rest against the corresponding counter leading inclined edges 34.

To close the case, the activating lever 10 simply has to be swung down from the high-swing position illustrated in FIG. 9. The leading inclined edges 33 lap over the stationary counter leading inclined edges 34, and then return to their locking position as in FIG. 2.

Whereas the unlocking of the two latches 21 occurs in synchronous, i.e. simultaneous, fashion, they can be locked independently from one another.

Spring 46 helps push the activating push-button 30 back into its normal position.

As a result of the trap functioning explained above, the case can also be closed when the correct combination has been erased.

All of the new characteristics mentioned in the description and depicted in the diagram are essential to the invention, even such as are not expressly claimed in the claims. 46.

I claim:

1. A locking apparatus mountable on one of a pair of container sections for releasably securing latches carried by the other container section, said locking apparatus comprising:

a housing elongated in a longitudinal direction, first and second latch-securing means mounted to said housing for releasably securing respective latches of the other container section, said first and second latch-securing means including first and second sliders each having an actuating end located remotely of a longitudinal center of said housing and an anchoring end including a stop shoulder located proximate said longitudinal center, said first and second sliders each being slidable by a first spring bias to a latch-releasing position in a longitudinal direction away from said longitudinal center and being slidable against said first spring bias to a latch-securing position in an opposite longitudinal direction toward said longitudinal center, first and second stop surfaces joined fixedly with said housing and arranged generally adjacent said longitudinal center for engaging respective ones of said stop shoulders when said sliders are in said latch-securing positions to retain said sliders against longitudinal movement to said latch-releasing positions, a manually displaceable activating member disposed generally adjacent said longitudinal center and being manually displaceable from a rest position to a slider-dislodging position for applying forces to both of said anchoring ends of said sliders in directions laterally of said longitudinal directions to dislodge said stop shoulders laterally out of engagement with said stop surfaces against a second spring bias to enable said sliders to be longitudinally moved to said latch-releasing positions by said first spring bias, and a combination lock mounted to said housing adjacent said longitudinal center and including a locking bar arranged to permit displacement of said manually displaceable member to said slider-dislodging position when said lock is on-combination, and to prevent such displacement when said lock is off-combination

2. Locking apparatus according to claim 1, wherein said first and second stop surfaces comprise first and second projections receivable in respective holes in said sliders, sides of said holes defining said stop shoulders.

3. Locking apparatus according to claim 1 including first and second guide walls fixedly joined to said housing, said first and second stop surfaces formed on said first and second guide walls, respectively, said activating member comprising a push button slidably guided in a direction laterally of said longitudinal directions by said first and second guide walls.

4. Locking apparatus according to claim 1, wherein said housing comprises a wall disposed opposite, and spaced laterally from, said anchoring ends to form a gap therebetween.

5. Locking apparatus according to claim 1, wherein said first and second stop surfaces are formed on projections, each of said anchoring ends including an inclined face enabling said anchoring end to be cammed laterally by a respective projection as said sliders are moved longitudinally to a latch-securing position.

6. Locking apparatus according to claim 5, wherein each of said projections is formed with an inclined face cooperating with said inclined face on said anchoring end.

7. Locking apparatus according to claim 1, wherein said activating member comprises a laterally movable push button, said locking bar being reciprocable longitudinally in and out of a lateral path of movement of said push button.

8. Locking apparatus according to claim 7, wherein said push button includes an inclined face engageable with said push button.

9. Locking apparatus according to claim 1, wherein said activating member comprises a push button having an end portion engageable simultaneously with both of said anchoring ends.

10. Locking apparatus according to claim 9, wherein said push button is hollow, and a spring is disposed therewithin to bias said push button away from said activating ends.

11. Locking apparatus according to claim 1, wherein said sliders are formed of plastic.

12. Locking apparatus according to claim 1, wherein said second spring bias is produced by inherent restoring forces of said sliders.

13. Locking apparatus according to claim 1, wherein each of said first and second latch-securing means includes a lever pivotably mounted to said housing and connected to an actuating end of a respective slider, said first spring bias produced by a spring biasing said lever to a latch-releasing position.

* * * * *